United States Patent [19]

English

[11] 4,411,312

[45] Oct. 25, 1983

[54] WATER-TIGHT CONDUIT WELL CAP

[75] Inventor: Donald H. English, Mount Herman, N.J.

[73] Assignee: Hewing Manufacturing Corporation, Columbia, N.J.

[21] Appl. No.: 181,875

[22] Filed: Aug. 26, 1980

[51] Int. Cl.[3] ..... E21B 33/02; E21B 41/00

[52] U.S. Cl. ..... 166/75 R; 220/293

[58] Field of Search ..... 166/75 R, 92, 93, 97; 220/293, 327, 319; 138/89; 292/301, 300; 404/25, 26; 52/20; 49/49

[56] References Cited

U.S. PATENT DOCUMENTS

| | | | |
|---|---|---|---|
| 1,578,194 | 3/1926 | Edelman | 292/300 |
| 2,401,923 | 6/1946 | Gleeson | 220/327 |
| 2,566,870 | 9/1952 | Beagle | 292/301 |
| 3,070,129 | 12/1962 | Poulallion | 138/89 |
| 3,473,573 | 10/1969 | Baker | 138/89 |
| 4,023,699 | 5/1977 | Lien | 166/75 |
| 4,233,697 | 11/1980 | Cornwell | 220/327 |

FOREIGN PATENT DOCUMENTS

| | | | |
|---|---|---|---|
| 2527966 | 1/1977 | Fed. Rep. of Germany | 404/26 |
| 1538172 | 7/1968 | France | 404/26 |

*Primary Examiner*—Stephen J. Novosad

*Assistant Examiner*—Joseph Falk

*Attorney, Agent, or Firm*—Berman, Aisenberg & Platt

[57] ABSTRACT

A tamper proof water-tight well cap has been developed to seal the outflow pipe of wells or tanks. The well cap includes a first member coaxially fitting over the outflow pipe having a plurality of peripherally arranged threaded bolt collars to receive and hold bolts. An annular collar member having a plurality of hollow bosses to accommodate bolts is arrayed on the outside circumferential surface of the annular collar member and the collar member has a plurality of radially inwardly extending tabs arranged about its inner circumferential surface. An annular compressible sealing member connects the first base member and the annular collar member to prevent any leakage of liquids into the well or tank. A plurality of bolts fitting through the openings in the bosses on the collar member are threaded into the bolt collars on the base member to hold both parts together. A substantially flat cap member having hooks extending axially downwardly and engaging the tabs to secure said cap to the annular collar member is mounted on top of the annular collar member and has an aperture to accept the bayonet lock pin. The bayonet lock pin fits through the aperture and engages a radial inward extending tab on the annular collar member thus preventing the rotation and removal of the cap.

12 Claims, 4 Drawing Figures

WATER-TIGHT CONDUIT WELL CAP

FIELD OF THE INVENTION

This invention relates to a water-tight conduit well cap cover to cover outlet pipes on underground wells or tanks.

BACKGROUND OF THE INVENTION

Conventional well caps provide a closure on the pipe leading from an underground well or tank to prevent surface liquid or contamination from entering the well or tank and unauthorized entry to the contents of the well or tank. The conventional well cap has a first collar surrounding the pipe and a dome cap attached to the collar sealed thereto and containing a sealing member therebetween to form a vapor and waterproof seal to prevent loss of well contents. Generally the well cap has an opening to allow conduit containing control wires to enter the well to allow control of the pump in the well or tank. Conventionally, the well cap is secured to a collar on the outlet pipe by exposed bolts which maintain the cap in position and retain gaskets in the cap to prevent surface water from entering the tank or well.

An example of a conventional well cap can be seen in U.S. Pat. No. 3,473,573 issued to J. J. Baker, on Oct. 21, 1969. The Baker cap discloses an outlet pipe having a follower ring 31 surrounding the outlet pipe having bolt lugs 32 to accept bolts. A dome cap structure 10 fits over the pipe outlet having peripherally arranged bolt lugs 12 to accommodate bolts which may be extended through the bolt lugs and in the follower ring to secure the cap in position. The well cap in Baker discloses an intermediate ring 22 interposed between the well cap and the follower ring and a ring gasket 27 coaxially interposed between the follower ring and the intermediate ring 22 to form a seal to prevent outside liquid or contamination from entering the tank. Gasket 19 is placed between the intermediate ring 22 and the dome structure 10 which forms a water and vapor-tight seal on the well cap to prevent surface water or liquid from entering the well. Also disclosed in Baker is a radial extension 13 to accommodate conduit containing control wires for the well pump contained in the well. The structure disclosed in Baker has exposed bolt heads and nuts 33 which can be unscrewed to expose the well. Baker discloses a conventional well cap and seal as known in the prior art.

One shortcoming of conventional well caps is that they are sealed on the outlet pipe by exposed bolt heads and nuts. As the bolt heads are exposed, they can be easily unbolted by anyone who wishes entry to the well, including both the well owner and one who is not the owner. To enhance security and prevent unauthorized tapping of the well, a structure must be devised that would prevent unauthorized access to the well or tank.

SUMMARY OF THE INVENTION

It is a primary object of the invention to provide a well cap that prevents unauthorized access to a well or tank to protect the contents from theft.

It is an important object of the present invention to provide a secure well cap that can be easily accessed by authorized individuals.

It is another important object of the invention to prepare a leakproof well cap which has a limited number of bolts closing it to provide easy and quick access to authorized personnel.

It is still another object of the invention to provide a well cap which is simple in construction and will require a limited number of parts in manufacture and assembly and will require little or no maintenance.

The above objects are achieved by the invention which, in a preferred embodiment, comprises a first annular base member coaxially fitting over a well pipe outlet having a plurality of peripherally arrayed first bolt collars. An annular collar member having a plurality of second bolt collars having internal openings which accommodate bolts are arrayed on the outside circumferential surface of the annular collar member. The annular collar member has a plurality of radially inward directed tabs arrayed about the inner circumferential surface of the annular collar and the annular collar member. A compressible seal for sealingly connecting the first annular base member and the annular collar member is sealingly interposed axially between the first annular base member and the annular collar member. Bolts are fitted through the openings in the first bolt collars in the first annular base member and the second bolt collars in the annular member securing the two together with the compressible seal therebetween. A substantially flat cap member having hooks extending axially downward engagingly fit over the radial inwardly directed tab members of the annular collar member to set the cap on the axial end of the annular collar member. The cap member has an aperture to accept a bayonet lock pin and has radially extended ears around the periphery which fit over the bolts. A bayonet lock pin fitting through the aperture in the cap adjacent a radially inwardly directed tab of the annular collar member locks the cap in position.

BRIEF DESCRIPTION OF THE DRAWING

The novel features that are considered characteristic of the invention are set forth in the appended claims. The invention itself, however, both as to its organization and method of operation, together with additional objects and advantages thereof, will best be understood from the following description of the specific embodiment, when read in connection with the accompanying drawings, wherein like reference characters indicate like parts throughout the several figures, and in which:

DESCRIPTION OF THE PREFERRED EMBODIMENT

Figure 1:
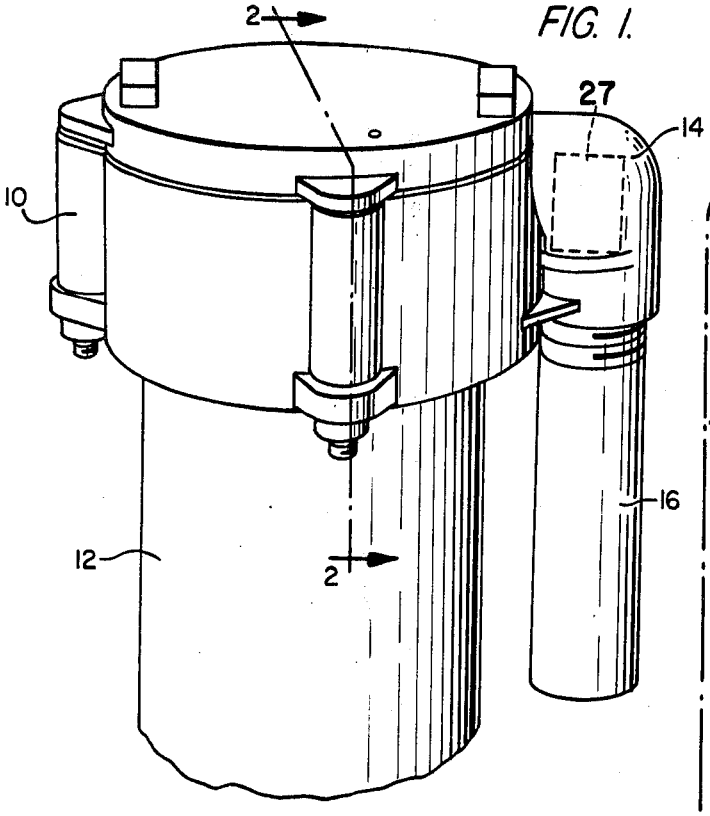
FIG. 1 is a perspective view of a preferred embodiment of the current invention.

Referring now particularly to the drawings, FIG. 1 shows a perspective view of the well cap in place on an outflow pipe of a well. Well cap 10 is coaxially centered on outflow pipe 12 having a domed radial member 14 which is threadingly engaged with conduit pipe 16. Conduit pipe 16 and radial member 14 accommodate conduit having control wires which penetrate through well cap 10 and down pipe 12 to power pumps contained in the well tank. A check valve 27 and passage is placed in the underside of domed radial member 14 (not visible in the drawings). Check valve 27 is preferably a ball valve and allows air to enter the well when liquid is drawn out, but closes to prevent entry of liquids from surface water or flooding. Thus, the well cap is vented for easy drawing and yet the well water is protected from unwanted outside contamination.

Figure 2:
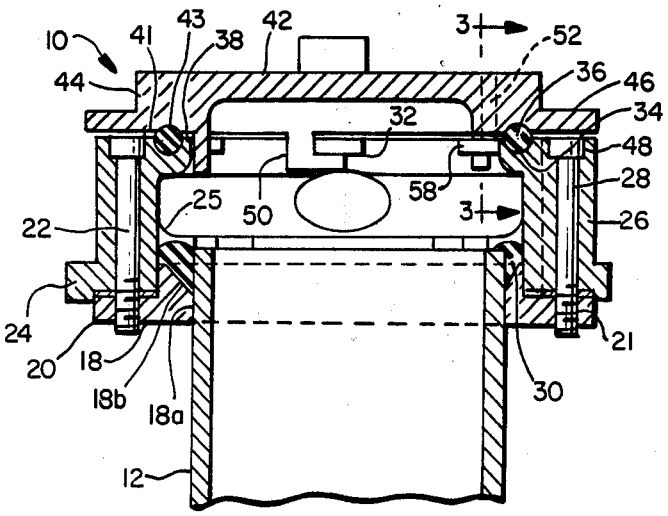
FIG. 2 is a side cross-sectional drawing of the well cap of FIG. 1 taken along section line 2—2.

As seen in FIG. 2 well cap 10 is coaxially centered on pipe 12. Well cap 10 comprises a number of components: a base member 18; an annular collar member 24 and cap member 40. Base member 18 comprises a generally annular member coaxially centered on pipe 12 having hollow bosses 20 containing threaded openings to accommodate bolts 22. Base member 18 has inner circumferential surface 18*a* adjacent pipe 12 and inclined surface 18*b*. Annular collar member 24 is coaxially centered on base member 18 and has hollow bosses 26 peripherally arrayed around the outer circumferential surface of annular collar member 24. Annular collar member 24 has a radially extending lip 25 along its inner circumferential surface. Bolts 22 fit through openings in hollow bosses 28 and extend through to hollow bosses 20 in base member 18 to secure the annular collar member 24 to the base member 18.

An annular compression gasket member 30 is interposed between annular collar member 24 and surface 18*b* of base member 18 to provide a seal to prevent any surface water or liquid from entering through the pipe 12 connected to the tank or the well below.

Annular collar member 24 has radial tabs 32 extending from the inner circumferential surface of the top axial edge of the annular collar member 24. Annular collar member 24 contains a circumferential groove 34 on its upper axial surface 38 to contain cap sealing gasket 36.

Cap member 40 is substantially cylindrical and forms a closure on the well seal preventing the entry of surface liquid into pipe 12. Cap member 40 has a substantially flat cap surface 42, annular walls 44 which abut on the axial surface 38 of annular cap member 24 and a substantially flat bottom surface 41 containing a groove 43 to sealingly engage the domed sealing gasket 36. The cap also has circumferentially spaced radially extending ears 46 which cover bolt heads 38 when the cap 40 is in place on the well seal and has axially extending hooks 50 extending downwardly from cap member 40 to hook over and partially engage radially extending tabs 32 on annular collar member 24. Interaction between hooks 50 and radial tabs 32 function to hold the cap member 40 in place.

Cap member 40 has a cap aperture 52 extending completely through it to accommodate bayonet hook pins 54 which, when placed in apertures 52, abut against the side of radially extending tabs 32 and lock the cap in position, preventing rotation of the cap by capturing radially extending tab 32 between a hook 50 and the bayonet hook pin 54.

Figure 3:
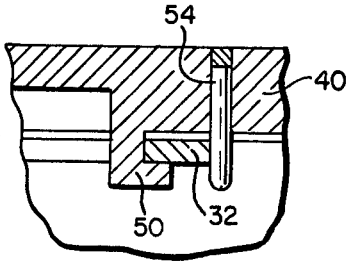
FIG. 3 is an enlarged section of a cross-sectional drawing of FIG. 2 indicated by section line 3—3.

Cap member 40 is in place and rotated to capture radial tabs 32 in hook 50. The presence of the bayonet hook pin 54 prevents rotation of the cap and maintains it in position as seen in FIG. 3. An effective seal is formed against the leakage of outside liquid or vapor into the tank or well by compression of gasket 36 between groove 34 of annular collar member 24 and groove 43 of cap member 40. When the cap member 40 is located and locked in position by the bayonet hook pin 54, radially extending ears 46 cover bolt heads 48 and prevent bolt heads from being removed.

Figure 4:
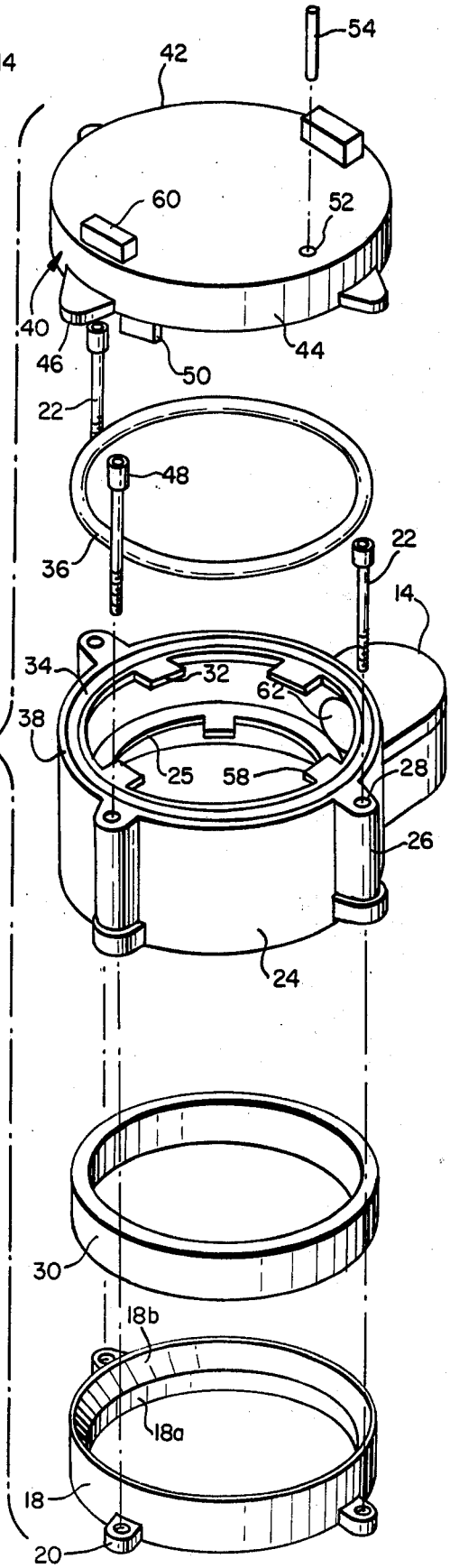
FIG. 4 is a perspective exploded view of the components of the subject of the current invention.

An exploded view of the water tight well cap can be seen in FIG. 4 wherein annular base member 18 is shown as having a plurality of peripherally arrayed bosses 20 with threaded apertures to receive and secure bolts 22. The internal circumference of the base member has a parallel surface 18*a* which abuts against the pipe and an inclined surface 18*b* which will accommodate the lower portion of gasket 30. Base member 18 is coaxially positioned on the pipe 12. Gasket 30 is coaxially centered on the pipe and placed with its lower surface in contact with inclined surface 18*b* of base member 18.

Annular collar member 24 is coaxially centered on the pipe and placed to abut gasket 30 capturing it between base member 18 and annular collar member 24. Internal radially extending lip 25 on the internal circumference of annular collar member 24 captures and compresses gasket 30 to form a fluid tight seal against pipe 12 to prevent any leakage of outside fluid from entering the well or tank through the well cap. As can be seen in FIG. 4, annular collar member 24 has a plurality of hollow bosses 26 having centrally disposed apertures 28 to receive bolts which are then screwed into threaded apertures 21 in bosses 20 on the base member 18.

Annular collar 24 has a plurality of radially inwardly extending ears 27 on its lower axial and which support, align and level the collar on top of the top edge of pipe 12. The ears support the collar on the edge of the pipe 12 during and after installation and function to allow gasket 30 to retain its shape and sealing position.

As seen in FIG. 4, conduit housing 14 is circumferentially located on the outside surface of annular collar member 24 and has an opening 62 through which power and control wires are threaded for connection to the electrical equipment submerged in the well or tank and check valve 27.

Bolts 22 are threaded through the openings 25 in hollow bosses 26 in annular collar member 24 and threaded into hollow bosses 20 to secure both the collar member and the base member together.

Cap sealing gasket 36 is then placed in the circumferential groove 34 on the top axial surface 38 of annular collar member 24. Cap member 40 is then in position and ready to be assembled on the annular cover member 24. Cap member 40 is placed within the central opening of annular collar member 24 and rotated so that axially extending hooks 50 engage the radially extending tabs 32 of member 24 to hold cap member 40 in position. When the axially extending hooks 50 of cap member 40 capture and engage the radially extending tabs 32, bayonet hook pin 54 is extended through the cap aperture 52 and engages the opposing side of tab 58 to prevent counter rotation of the cap member.

Rotation of the cap member 40 is enhanced through the presence of leverage lugs 60 on opposite ends of the cap which allow a tool to be placed therebetween to rotate cap 40 in the direction to put it in position to unlock the cap. When cap 40 is locked in position, radially extending ears 46 cover the top of bolt 22 and will prevent access to those bolts for loosening them to gain access to the well.

When the well cap is fully assembled and bayonet hook pin 54 is properly inserted, a putty matching the color of the well cap is spread over the top surface of the cap member 40 and conceals the position of bayonet hook pin 54. The presence of the bayonet hook pin 54 prevents rotation and removal of cap member 40 to gain access to the well. Without knowing of the existence and position of bayonet lock pin 54 on the cap member 40, the well is protected from unauthorized use. Furthermore, the use of only one lock pin member and the axially extending hooks 50 substantially simplifies the construction of the well cap and eliminates the need to use many different bolts and nuts to secure it in place and the associated labor time with removing the additional bolts and nuts in order to remove the well cap.

Although a certain specific embodiment of the invention has been shown and described, it is obvious that many modifications thereof are possible. It therefore is not intended to be limited to the exact showing and description thereof, but the scope of the invention is considered to include reasonable and obvious equivalents thereof.

What is claimed is:

1. A pipe cover comprising:

(a) an annular base member sealingly attached to a pipe, and having a plurality of radial tabs inwardly extending from the top annular surface thereof;

(b) a cap member having a plurality of hooks axially extending into the base member and sealingly placed on an axial end of said base member and said cap member having an aperture therein to receive a bayonet pin member;

(c) a bayonet pin fitting into said cap aperture and extending beyond said cap to prevent rotation of the cap; and (d) at least two leverage lugs protruding from the top surface of said cap member to allow for turning of said cap member.

2. A pipe cover comprising:

(a) a first member coaxially fitting over a pipe having a plurality of peripherally arranged threaded bolt collars for receiving and holding a bolt;

(b) an annular collar member having a plurality of hollow bosses having internal openings to accommodate bolts arrayed on the outside circumferential surface of said annular collar member, said collar member having a plurality of radially inwardly extending tabs arranged about its inner circumferential surface;

(c) means for sealingly connecting said first member to said annular collar member;

(d) a plurality of bolts fitting through said openings in said bosses and threaded into said bolt collars;

(e) a substantially flat cap member sealingly placed on an annular end of the annular collar members and having hooks extending axially downwardly into said cap member having an aperture; and (f) a bayonet lock pin fitting through said aperture and engaging a radially inwardly extending tab on the annular collar.

3. A pipe cover as claimed in claims 1 or 2 wherein there is a means to seal said cap and said annular collar.

4. The pipe cover of claims 1 or 2 wherein the top of said pin lies below an upper surface of said cap member, and a sealant covers the outside surface of said pin to mask the position of said pin.

5. A pipe cover as claimed in claim 2 wherein there are at least two leverage lugs protruding from the top surface of said cap member to allow for turning of said cap member.

6. The pipe cover as claimed in claims 1 or 2 wherein said annular base member has a conduit housing radially disposed on the outside circumferential surface of said annular collar member having an enclosed passage for communication with said annular collar member.

7. The pipe cover claimed in claim 2 wherein said means for sealingly connecting said first base member and said collar member is an annular member sealing engaging said first base member on an axial surface thereof and sealingly engaging an axial surface of said annular collar member.

8. The pipe cover as claimed in claims 1 or 2 wherein there is a means for allowing air to enter said pipe while preventing the entry of liquids into said pipe.

9. The pipe cover as claimed in claim 8 wherein said means for allowing the air to enter said pipe while preventing the entry of liquids into said pipe is a check valve.

10. The pipe cover claimed in claim 2 wherein said annular collar member has a plurality of radially inwardly extending ears on the axial end oppositely disposed from said plurality of radially inwardly extending tabs which abut against and support said annular collar member upon the end of the pipe.

11. A pipe cover comprising:

a base member, means on an outer surface of said base member for attaching said base member to an end of a pipe, cap means for covering said base member and said end, and having a hole for receiving a pin, said cap means having means for securing said base to said cap means for one rotational position of said cap means with respect to said base member, and for releasing said base member for another rotational position, said cap means having means for covering said means for attaching to prevent said means from being removed from said pipe when said cap means is in said one rotational position, and for uncovering said means for attaching when said cap means is in said another rotational position, and a pin for extending through said hole in said cap means to prevent relative rotation between said cap means and said base member when said cap means is in said one rotational position.

12. The pipe cover of claim 11 wherein the top of said pin lies below the upper surface of said cap means, and a sealant is placed in said hole for masking the location of said pin.

* * * * *